US005324603A

United States Patent [19]

Jin et al.

[11] Patent Number: 5,324,603

[45] Date of Patent: Jun. 28, 1994

[54] METHOD FOR FORMING AN IMAGE ON A MAGNETIC COMPOSITE MEDIUM AND APPARATUS THEREFOR

[75] Inventors: Sungho Jin, Millington; Thomas H. Tiefel, North Plainfield, both of N.J.

[73] Assignee: AT&T Bell Laboratories, Murray Hill, N.J.

[21] Appl. No.: 870,524

[22] Filed: Apr. 17, 1992

[51] Int. Cl.[5] ..... G03G 19/00

[52] U.S. Cl. ..... 430/39; 430/31

[58] Field of Search ..... 430/39, 30, 31

[56] References Cited

U.S. PATENT DOCUMENTS

| | | | |
|---|---|---|---|
| 4,506,000 | 3/1985 | Kubota et al. | 430/39 |
| 4,644,101 | 2/1987 | Jin et al. | 178/18 |
| 4,737,112 | 4/1988 | Jin | 439/66 |
| 5,045,249 | 9/1991 | Jin | 264/24 |

FOREIGN PATENT DOCUMENTS

| | | | |
|---|---|---|---|
| 0075658 | 6/1981 | Japan | 430/39 |
| 62-067625 | 3/1987 | Japan | G06F 3/03 |
| 3158880 | 7/1991 | Japan | 430/39 |
| 2071865A | 9/1981 | United Kingdom | 1/17 |

OTHER PUBLICATIONS

Xerox Disclosure Journal, "Magneto-Fluid Display", vol. 1 No. 9/10, (1976), p. 53.

S. Jin, et al. "Optically Transparent, Electrically Conductive Composite Medium", *Science*, vol. 255, pp. 446-448, (1992).

B. D. Cullity, *Introduction To Magnetic Materials*, Addison-Wesley, Menlo Park A, p. 491 (1972).

R. J. Parker, *Advances in Permanent Magnetism*, John Wiley & Sons, New York.

T. Lyman, Ed., *Metals Handbook*, 8th Ed., vol. 1 -*Properties and Selection of Metals*, American Soc. for Metals, OH, 1961, p. 779.

Jin, S. et al., "New, Z-direction anisotropically conductive composites," *J. Appl. Phys.*, vol. 64, No. 10, Nov. 15, 1988, pp. 6008-6010.

*Primary Examiner*—John Kight, III
*Assistant Examiner*—Dvc Truong
*Attorney, Agent, or Firm*—Glen E. Books

[57] ABSTRACT

In accordance with the invention, an image is formed by applying a local magnetic field to selected regions of a magnetic composite medium comprising columns of magnetic particles distributed in a matrix medium. The particles are "hard" or "semi-hard" magnetic materials in order to retain the latent image as residual magnetism, and the image is developed by exposure to magnetic fluid or powders. The image can be erased by exposure to an AC demagnetizing field or a DC sweep magnet. Preferred apparatus for making such images comprises a sheet of such composite material having a pair of major surfaces with columns of magnetic particles oriented between the surfaces. A local magnetic field, such as a magnetic pen, can be used to write a latent magnetic image on one of the major surfaces. The magnetic columns present the latent image for development at either major surface. In preferred apparatus, one major surface is adapted for magnetic image writing and the other major surface is positioned in sealed relationship with a chamber for exposing the image to magnetic development material. In this arrangement the columns provide a high resolution image on the second surface despite the thickness of the medium between the write and development surfaces.

9 Claims, 1 Drawing Sheet

METHOD FOR FORMING AN IMAGE ON A MAGNETIC COMPOSITE MEDIUM AND APPARATUS THEREFOR

FIELD OF THE INVENTION

This invention relates to a method for forming an image on a magnetic composite medium and to apparatus particularly suited for such image formation.

BACKGROUND OF THE INVENTION

In the Jan. 24, 1992 issue of Science (Vol. 255, p. 446), applicants Jin and Tiefel describe a class of composite materials which are optically transparent and, at the same time, electrically conductive. These composite materials comprise sheets of polymer containing columns of magnetic conducting spheres.

Such composite materials have a variety of uses due to their anisotropic electrical conductivity. They conduct through the thickness of the material but not laterally. U.S. Pat. No. 4,644,101 issued to Sungho Jin et al. on Feb. 17, 1987 discloses the use of such materials in a pressure-responsive position sensor. The operative principle is that applied pressure forces the spheres through any intervening polymer into contact with one another and through the polymer to the surface. U.S. Pat. No. 5,049,249 shows the use of such material as a means for providing electrical contact between protruding electrical contact regions. The protruding contacts press on the conductive columns to enhance electrical contact.

The present invention is concerned with the magnetic properties of a composite medium rather than its electrical properties, and it is specifically concerned with the use of a composite medium as a material upon which erasable magnetic images can be written and developed.

SUMMARY OF THE INVENTION

In accordance with the invention, an image is formed by applying a local magnetic field to selected regions of a magnetic composite medium comprising columns of magnetic particles distributed in a matrix medium. The particles are "hard" or "semi-hard" magnetic materials in order to retain the latent image as residual magnetism, and the image is developed by exposure to magnetic fluid or powders. The image can be erased by exposure to an AC demagnetizing field or a DC sweep magnet. Preferred apparatus for making such images comprises a sheet of such composite material having a pair of major surfaces with columns of magnetic particles oriented between the surfaces. A local magnetic field, such as a magnetic pen, can be used to write a latent magnetic image on one of the major surfaces. The magnetic columns present the latent image for development at either major surface. In preferred apparatus, one major surface is adapted for magnetic image writing and the other major surface is positioned in sealed relationship with a chamber for exposing the image to magnetic development material. In this arrangement the columns provide a high resolution image on the second surface despite the thickness of the medium between the write and development surfaces.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that these drawings are for purposes of illustrating the concepts of the invention and are not to scale.

DETAILED DESCRIPTION

Figure 1:
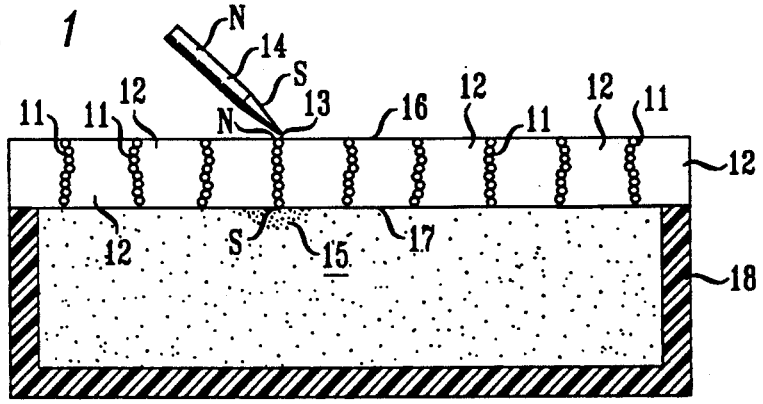
FIG. 1 is a schematic cross section illustrating a method and a preferred apparatus for forming an image in accordance with the invention.

Referring to the drawings, FIG. 1 is a schematic cross section illustrating a method and a preferred apparatus for forming an image in accordance with the invention. In essence, the method of image formation comprises the steps of providing a magnetic composite medium 10 comprising columns 11 of magnetic particles distributed in a nonmagnetic medium 12, forming a latent image 13 by applying a local magnetic field, as from a magnetic pen 14, to a selected portion of the medium. The latent image is developed by applying magnetic fluid or powder 15 and allowing the applied material to accumulate on the image.

In the preferred apparatus for forming such an image, the composite medium 10 is in the form of a layer having two major surfaces 16 and 17. One major surface, e.g. 16, which can be called a write surface, is adapted to permit the writing of a magnetic image without loss of magnetic particles. For example, a wear resistant polymer such as polyurethane is coated on the surface in sufficient thickness that the columnar particles are not extracted by the write pen. The second major surface 17, which can be called the development surface, can be positioned is sealed relation with a development chamber 18 containing the development fluid 15. The presence of magnetic columns 11 extending substantially between the two major surfaces enables a magnetic image written on surface 16 to be developed as a high resolution image on surface 17 despite the intervening distance between the two surfaces. Alternatively, the latent image can be developed on the same surface on which it is written.

Figure 2:
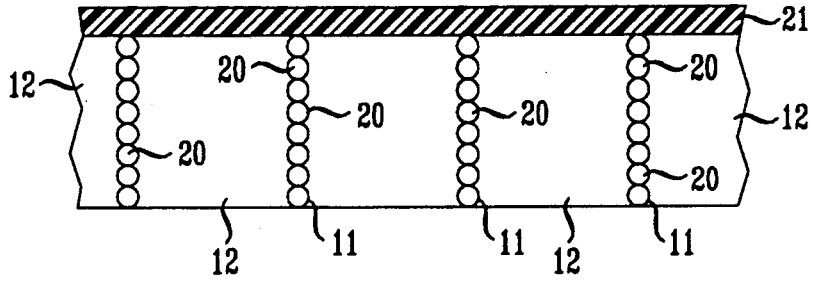
FIGS. 2–4 are schematic cross sections of preferred magnetic media for image formation.

The preferred magnetic composite medium 10 is shown in greater detail in FIG. 2. The composite medium 10 is similar to those described in the aforementioned Jin et al article and patents except that the composite medium is made of higher coercivity $H_c$ magnetic materials with permanent remanent induction. The earlier composites use soft magnetic particles such as nickel, with typical coercive force ($H_c$) of less than 10 $O_e$. See R. M. Bozorth, *Ferromagnetism*, D. Van Nostrand Co., Inc, New York, 1951, p. 275. Such soft magnetic materials do not retain much magnet strength, and they exhibit small or negligible remanent induction after the applied field is removed. See *Metals Handbook*, 8th ed., Vol. 1. American Society for Metals, 1961, p. 779, and B. D. Cullity, *Introduction to Magnetic Materials*, Addison-Wesley, Menlo Park (A, 1972, p. 491). They are easily demagnetized especially if the magnetized material has an aspect ratio of less than about 100.

The medium for the present application is made so that the particles will not escape the write surface. The medium comprises columns 11 of high coercivity magnetic particles 20 distributed in a matrix medium 12. Preferably, a protective layer 21 is disposed on the write surface of the medium to prevent the particles 20 from breaking through to the surface where they could be removed by the magnetic writing pen 14. If the matrix material is an adhesive or rigid material such as epoxy or glass, then the protective layer is not needed.

The particles 20 are magnetic particles made of permanent or semi-hard magnet materials having $H_c > 100$ $O_e$. For example, they can be magnetic alloys such as $Nd_2Fe_{14}B$, Alnico, Fe-Cr-Co, or rare-earth cobalt magnets $SmCo_5$ or $Sm_2Co_{17}$. Alternatively, they can be non-conductive or weakly conductive ferrite magnets such as $BaO.6Fe_2O_3$ or $SrO.6Fe_2O_3$. For permanent image storage, materials having $H_c > 200$ $O_e$ and preferably $H_c > 1000$ $O_e$ are desirable. Advantageously, the particles are coated with a corrosion resistant material such as gold or silver for corrosion resistance and to reduce light absorption. Typical particle diameters are in the range 0.1 to 2000 micrometers with a preferred range of 10–500 micrometers.

The matrix material 12 can be a polymeric material such as an elastomer or adhesive or it can be a glass. For typical magnetic image applications the material can be compliant or rigid. It is important for the fabrication of medium 10 that the matrix be a material that goes through a viscous state before curing or setting. Useful materials include silicone elastomers, epoxies, polyurethane resins and glasses. While transparent media are preferred for a number of applications, the material can be lightly colored for decoration. Typical thicknesses are on the order 2–5000 micrometers and preferably 10–500 micrometers.

Medium 10 can be fabricated starting with matrix material 12 in a viscous state. Magnetic particles 20 are demagnetized and mixed with the viscous material in a volume fraction of 0.1–20% but preferably 0.5–5%. After mixing, the material is formed into a layer, as by doctor blading, and, while initially in the viscous state, is subjected to a magnetic field of 50–5000 $O_e$, and preferably 200–1000 $O_e$ during hardening or cure. The effect of the magnetic field is to cause the magnetic particles to move in the viscous material into a configuration of columns 11 extending substantially through the medium at random locations distributed with substantially uniform density in the medium.

The method of cure or hardening depends on the nature of the matrix material. Polymerizing and thermosetting materials can be heated in an oven. Light sensitive resins can be cured by exposure to radiation of appropriate frequency, and glasses, thermoplastic materials or inorganic compounds can be solidified by cooling. After hardening a protective layer 21, such as polyurethane, can be formed on the write surface of the medium to keep the particles 20 from being extracted during the write operation.

The advantages of this medium and apparatus for magnetic image formation are manifold. Resolution is enhanced because it is easier to magnetize particles in a column and obtain stronger flux from their ends due to the improved aspect ratio when the particles are in a column configuration. Moreover the columnar configuration extending substantially through medium 10 permits writing on one surface, e.g. the top surface, and development of a sharply defined image on the other surface, e.g. the bottom. This establishes magnetic flux lines close to the display medium while permitting enclosure of the development medium away from the user. This feature can be used to prevent leakage of magnetic powders and ferrofluids. Moreover, the use of a column configuration—as distinguished from a random distribution of magnetic particles—permits better transparency for medium 10 than would be present for the same content of randomly distributed particles.

Writing of an image can be accomplished by using either a permanent magnet pen or an electromagnet pen. The pen can be hand-held or machine-controlled, such as the stylus on an X-Y recorder.

Erasure of a written image can be effected in a variety of ways. One approach is to use a permanent magnet or electromagnet to uniformly magnetize the write surface. Another approach is to use a permanent magnet or electromagnet to demagnetize the surface. Yet another approach is to use an erase pen of opposite polarity to erase the image locally.

Figure 3:
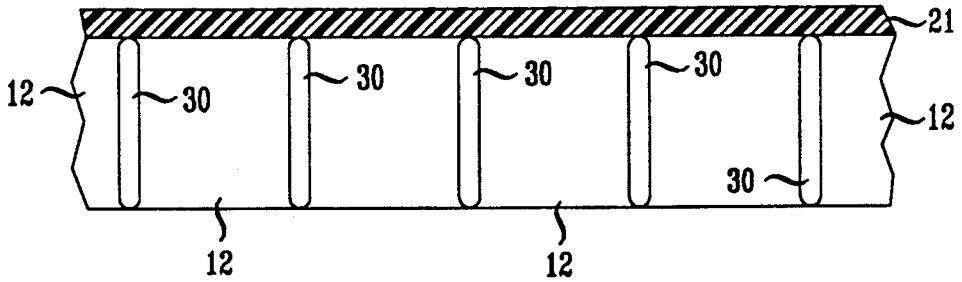

FIG. 3 is a schematic cross section of an alternative form of the medium 10 where the magnetic particles 30 are in the form of magnetic rods having a length approximately equal to the medium thickness.

Figure 4:
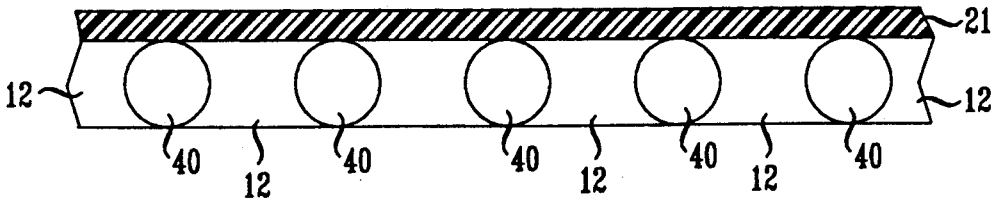

FIG. 4 is a schematic cross section of yet another embodiment where the magnetic particles 40 are spheres having diameters approximately equal to the medium thickness. Fabrication of such a medium is described in greater detail in applicants' U.S. Pat. No. 4,737,112 issued Apr. 12, 1988 and entitled "Anisotropically Conductive Composite Medium".

The fabrication and structure of the invention can be understood in greater detail by consideration of the following specific example. 3.5% by volume of $Sm_2Co_{17}$ magnet particles having diameters in the range 200–250 micrometers were mixed in General Electric RTV#615 elastomer. The mixture was then sheeted out as a 600 micrometer sheet onto a glass substrate and exposed to a vertical magnetic field (across the thickness) of 300 $O_e$ while curing the elastomer at 130° C. for 20 min. The resulting medium comprised columns of magnetic particles extending substantially through the 600 micrometer thickness and distributed with a substantially uniform average distribution spacing. The medium exhibit a transmittance of about 75% in the visible light range.

An image of the letter "A" was then written on the medium by a Nd-Fe-B magnetic pen having a 1/16" radius tip (field estimated to be 1600 $O_e$). The image was developed by placing a sheet of white paper over the same and sprinkling Fe powder (25–100 micrometer diameters) onto the sheet and gently tapping. The result was a visible image of the written "A".

An eraser pen with opposite polarity field of 600 $O_e$ was moved over the written "A" on the composite medium, and it was erased. In other experiments the image was erased by uniform magnetizing effected by sweeping a vertical field of 3400 $O_e$ across the surface. Alternatively, a similar image was erased using demagnetization by applying an opposite polarity field of 1100 $O_e$ across an air gap.

It is to be understood that the above-described embodiments are illustrative of only some of the many possible specific embodiments which can represent applications of the principles of the invention. Numerous and varied other arrangements can be made by those skilled in the art without departing from the spirit and scope of the invention.

We claims:

1. A method for magnetically forming an image comprising the steps of:

providing a sheet of composite material having a pair of major surfaces comprising a non-magnetic matrix material and a plurality of columns of magnetic particles extending between said major surfaces;

writing a latent magnetic image on a major surface of said sheet; and developing said latent image by exposing said sheet to magnetic fluid or powder.

2. The method of claim 1, wherein said latent image is written on one major surface of said sheet and said latent image is developed on the other major surface.

3. A magnetic composite medium for magnetic image formation comprising:

a layer of non-magnetic matrix material having a pair of major surfaces comprising a plurality of columns of magnetic particles extending between said major surfaces, said magnetic particles being comprised of high coercivity magnetic materials having coercivity $H_c > 200\ O_c$.

4. A magnetic composite medium according to claim 3, wherein said magnetic particles are comprised of high coercivity magnetic materials having $H_c > 200\ O_e$.

5. A magnetic composite medium according to claim 3, further comprising on one of said major surfaces a protective layer for preventing extraction of said particles from said surface.

6. A magnetic composite medium according to claim 3, wherein said magnetic particles are rod shaped.

7. A magnetic composite medium according to claim 3, wherein said magnetic particles are spherically shaped.

8. A method for making a magnetic composite medium for magnetic image formation comprising the steps of:

providing a hardenable, non-magnetic material in a viscous state;

mixing in said material demagnetized particles of magnetic material having $H_c > 100\ O_e$;

forming said mixture into a sheet; and exposing said sheet while initially in a viscous state to a magnetic field, and causing said sheet to harden.

9. The method of claim 8, including the step of applying to at least one surface of said sheet a protective layer to prevent extraction of magnetic particles from said surface.

* * * * *